US006786495B1

(12) United States Patent
Browning

(10) Patent No.: US 6,786,495 B1
(45) Date of Patent: Sep. 7, 2004

(54) TUMBLING TOY

(76) Inventor: Christopher G Browning, 2313 Byrd St., Raleigh, NC (US) 27608

( * ) Notice: Subject to any disclaimer, the term of this patent is extended or adjusted under 35 U.S.C. 154(b) by 86 days.

(21) Appl. No.: 10/054,303

(22) Filed: Jan. 22, 2002

(51) Int. Cl.[7] ..... A63G 29/00
(52) U.S. Cl. ..... 280/206
(58) Field of Search ..... 446/450, 451, 446/431; 280/205, 206, 208; 301/111.01, 111.03, 124.1, 126

(56) References Cited

U.S. PATENT DOCUMENTS

| | | | | | |
|---|---|---|---|---|---|
| 1,557,321 | A | * | 10/1925 | Parke | 446/448 |
| 1,948,136 | A | * | 2/1934 | Scheckler | 301/38.1 |
| 2,001,205 | A | * | 5/1935 | Marten | 280/207 |
| D167,975 | S | * | 10/1952 | Fisher et al. | D21/455 |
| 2,635,012 | A | * | 4/1953 | Rappaport | 301/36.1 |
| D182,791 | S | * | 5/1958 | Crawford | D21/455 |
| 3,037,321 | A | * | 6/1962 | Thomason | 446/452 |
| 3,066,951 | A | | 12/1962 | Gray | |
| 3,193,286 | A | * | 7/1965 | Sitter | 482/77 |
| 3,338,593 | A | * | 8/1967 | Gehring | 280/206 |
| 3,371,943 | A | * | 3/1968 | Turgetto | 280/206 |
| 3,428,015 | A | | 2/1969 | Cloud | |
| 3,460,828 | A | | 8/1969 | Curlee | |
| 3,464,718 | A | * | 9/1969 | Fisher | 280/206 |
| 3,537,726 | A | | 11/1970 | Conover | |
| 3,575,443 | A | | 4/1971 | Aguilar | |
| 3,718,342 | A | * | 2/1973 | Freed | 280/87.01 |
| 3,758,984 | A | * | 9/1973 | Spransy et al. | 446/453 |
| 3,790,218 | A | * | 2/1974 | Johns | 301/36.1 |
| 3,893,707 | A | * | 7/1975 | Samsel | 280/208 |
| 4,364,579 | A | * | 12/1982 | Fisher | 280/206 |
| 4,401,314 | A | | 8/1983 | Zimmerman | |
| D272,927 | S | * | 3/1984 | Dropik | D21/455 |
| 4,604,074 | A | * | 8/1986 | Engle et al. | 446/171 |
| 4,818,031 | A | * | 4/1989 | Brown | 301/36.1 |
| 4,925,250 | A | * | 5/1990 | Sorrentino et al. | 301/13.1 |
| D344,105 | S | * | 2/1994 | Offutt | D21/421 |
| 5,288,262 | A | * | 2/1994 | Phillips | 446/451 |

* cited by examiner

*Primary Examiner*—Lesley D. Morris
*Assistant Examiner*—Paul Royal, Jr.
(74) *Attorney, Agent, or Firm*—Coats & Bennett, P.L.L.C.

(57) ABSTRACT

A tumbling toy that permits children to be received and supported within a central tube. The tumbling toy includes a pair of wheels that support the tube. A pull is connected to the tumbling toy, allowing the tumbling toy to be pulled over the ground or other support surface. As the tumbling toy is moved over the ground or support surface, it follows that children supported within the tube will be subjected to a tumbling action.

26 Claims, 5 Drawing Sheets

TUMBLING TOY

FIELD OF INVENTION

The present invention relates to toys and more particularly to a pull-type tumbling toy.

SUMMARY OF THE INVENTION

The present invention entails a tumbling toy including a tumbling tube and a pair of spaced apart wheels for supporting the tumbling tube. A pull is connected to the tumbling toy such that as the tumbling toy is pulled the tumbling tube and wheels rotate relative to the pull.

In one particular embodiment of the present invention, the wheels are constructed of a pliable inflatable material while the tumbling tube is constructed of a rigid material. While the tumbling toy is packaged and during shipment, the wheels are deflated, reducing the package size and generally reducing the cost of shipping and storage.

In another particular embodiment of the present invention, the wheels are constructed of a pliable inflatable material. When the wheels are inflated, they extend around opposed end portions of the tumbling tube such that the tumbling tube itself projects through the inflated wheels. The wheels may be retained on the tumbling tube in various ways. In one exemplary embodiment there is provided a series of straps that extend from the tumbling tube over the wheels so as to secure the wheels to the tumbling tube.

Other objects and advantages of the present invention will become apparent and obvious from a study of the following description and the accompanying drawings which are merely illustrative of such invention.

DESCRIPTION OF EXEMPLARY EMBODIMENTS

Figure 1:
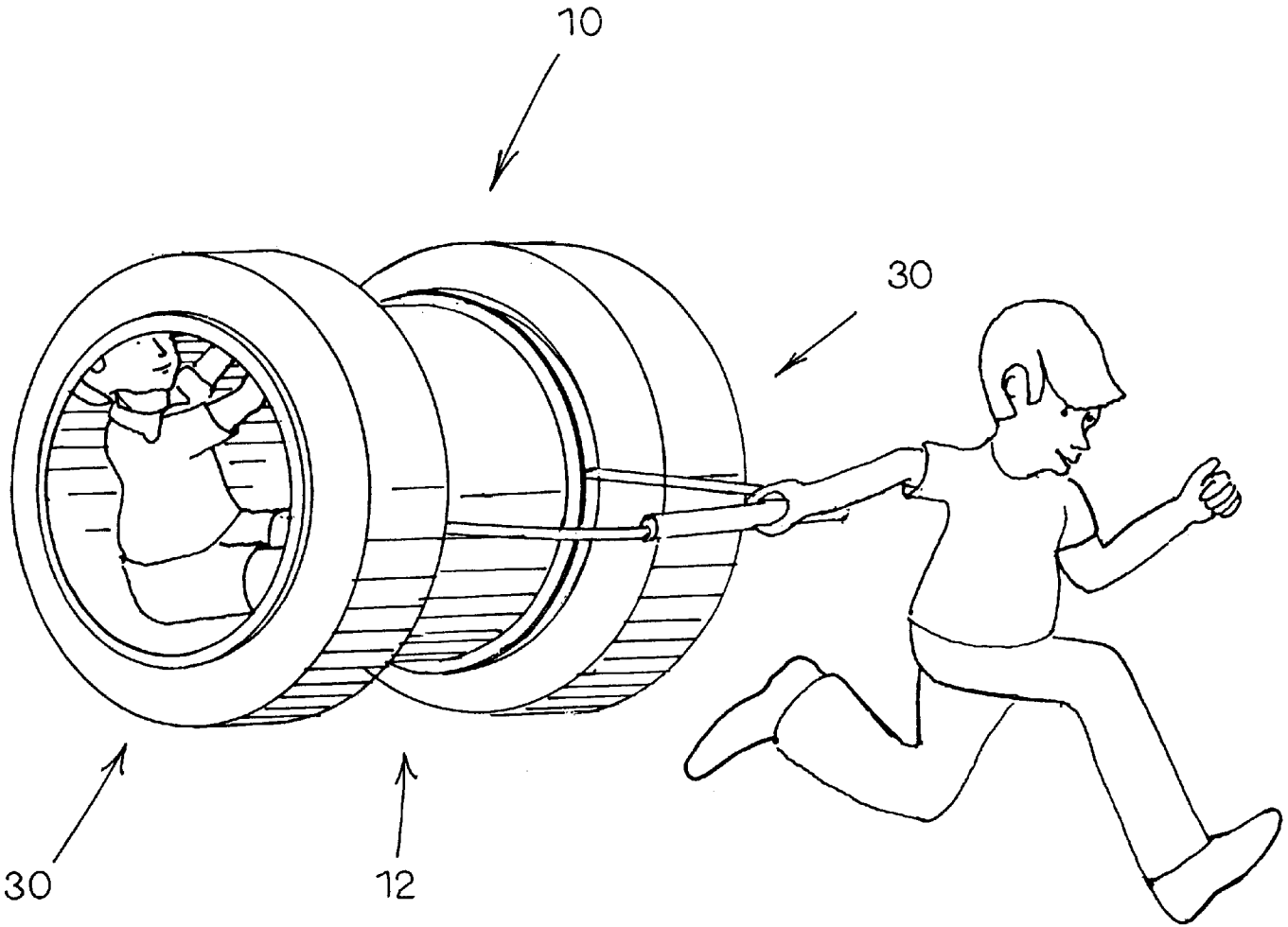
FIG. 1 is a perspective view of the tumbling toy of the present invention.

With further reference to the drawings, the tumbling toy of the present invention is shown therein and indicated generally by the numeral 10. As will be appreciated from subsequent portions of this disclosure, the tumbling toy 10 is designed and adapted to enable children or even adults to be supported within the tumbling toy. By pulling the tumbling toy over the ground or other support surface, or even over water, children or other individuals supported within the tumbling toy will be subjected to a tumbling action.

Now turning to a description of the tumbling toy 10, it is seen from the drawings that the tumbling toy 10 comprises an elongated tube indicated generally by the numeral 12. In the embodiments illustrated herein, the tube 12 is generally rigid. While the tube may be constructed of various materials, it is contemplated that in a number of embodiments that the tube would be constructed of a generally rigid plastic material. As seen in the drawings, tube 12 includes an outer cylindrical surface 14 and an inner cylindrical surface 16. Formed about each side of the tube 12 is a circumferential flange 18. Circumferential flange 18 is simply an extension of the cylindrical wall of the tube 12 and is turned down about opposed ends of the tube 12. Further, as seen in the drawings, the circumferential flange 18 extends in a circular or annular fashion around the outer end portions of the tube 12. Also, formed on the tube 12 is a pair of guide structures. Each guide structure includes a pair of guide rails or ridges 20 that extend upwardly from the outer surface 14 of the tube 12. Defined between the guide rails or ridges 20 is a space and as will be appreciated from subsequent portions of the disclosure, the space between the guide rails 20 serve to receive and confine a part of the pull structure.

Disposed interiorly within the tube 12 is a series of handholds 26. The hand holds 26 can be provided and spaced at various locations interiorly of the tube 12. However, it is contemplated that in some embodiments, there would be a series of hand holds 26 provided about each end portion of the tube 12. Various types of hand hold structures can be provided but it is contemplated that a typical hand hold device or structure would be in the form of a flexible and pliable loop secured to the inner surface 16 of the tube.

Supporting the tube 12 is a pair of wheels, each wheel being indicated generally by the numeral 30. In the embodiment illustrated in FIGS. 2 and 3, wheels 30 are inflatable. More particularly, each wheel 30 is constructed of a pliable inflatable material. Note that the wheels 30 when inflated extend around outer portions of the tube 12. In fact, the tube 12 projects through each of the wheels 30 and thereby support the wheels. Various means can be provided for securing the inflatable wheels 30 to the tube. For example, an inner portion or segment of each wheel can be glued or secured by an adhesive to the outer surface 14 of the tube. In the embodiment illustrated in FIGS. 2 and 3, the inflatable wheels 30 are, secured about outer end portions of the tube 14 by a series of straps 32. The straps 32 are positioned in pairs and include hook and loop fasteners that permit the strap pairs to be secured together. One strap of each pair, as shown in FIG. 3, is secured to the adjacent flange 18 of the tube. The other strap of the pair is secured just outwardly of the guide rails or ridges 20. When a wheel 32 is inflated, the pair of straps is extended transversely around the wheel 32 and is secured together in such a fashion that the wheel is retained about the outer portion of the tube 12. Note in the drawings that the straps 32 are circumferentially spaced around each wheel 32.

Figure 2:
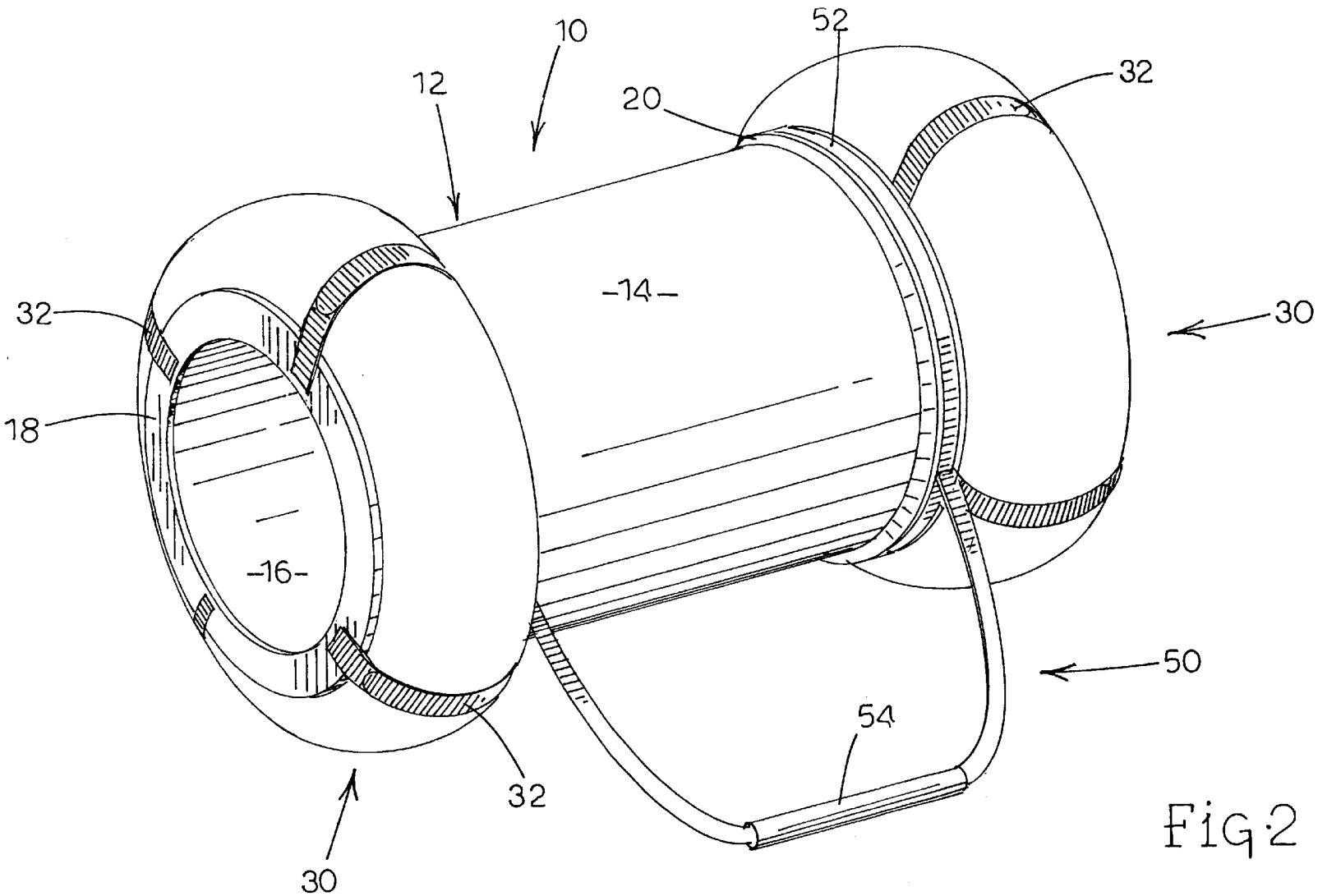
FIG. 2 is a perspective view of one particular embodiment of the tumbling toy.
Figure 3:
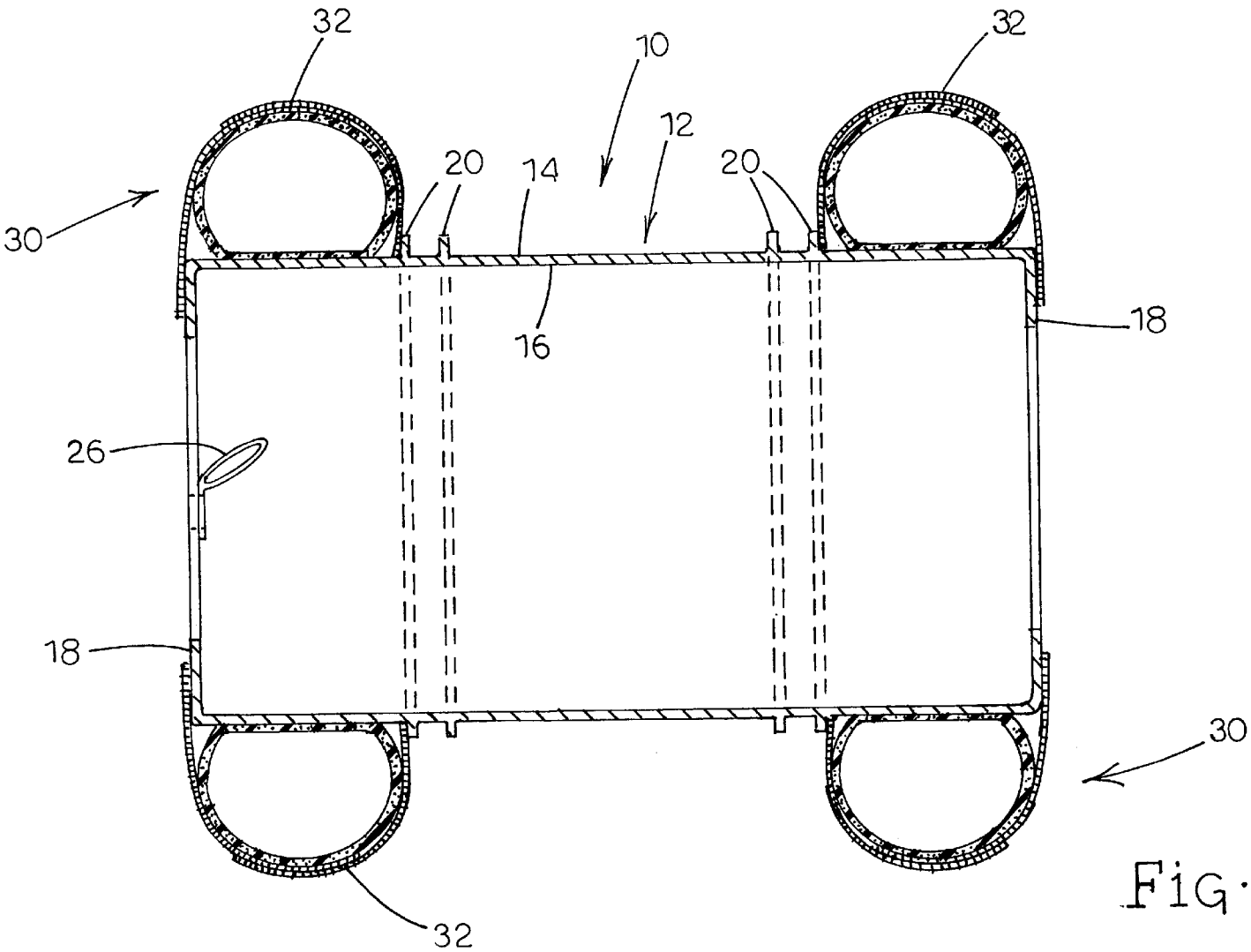
FIG. 3 is a transverse sectional view of the tumbling toy shown in FIG. 2.

In the case of the embodiment illustrated in FIGS. 2 and 3, the wheels 32 can assume a deflated mode for purposes of packaging, storage and shipment. This will effectively reduce the size of the packaging for the tumbling toy 10 and will in the end reduce storage and shipment costs.

Figure 4:
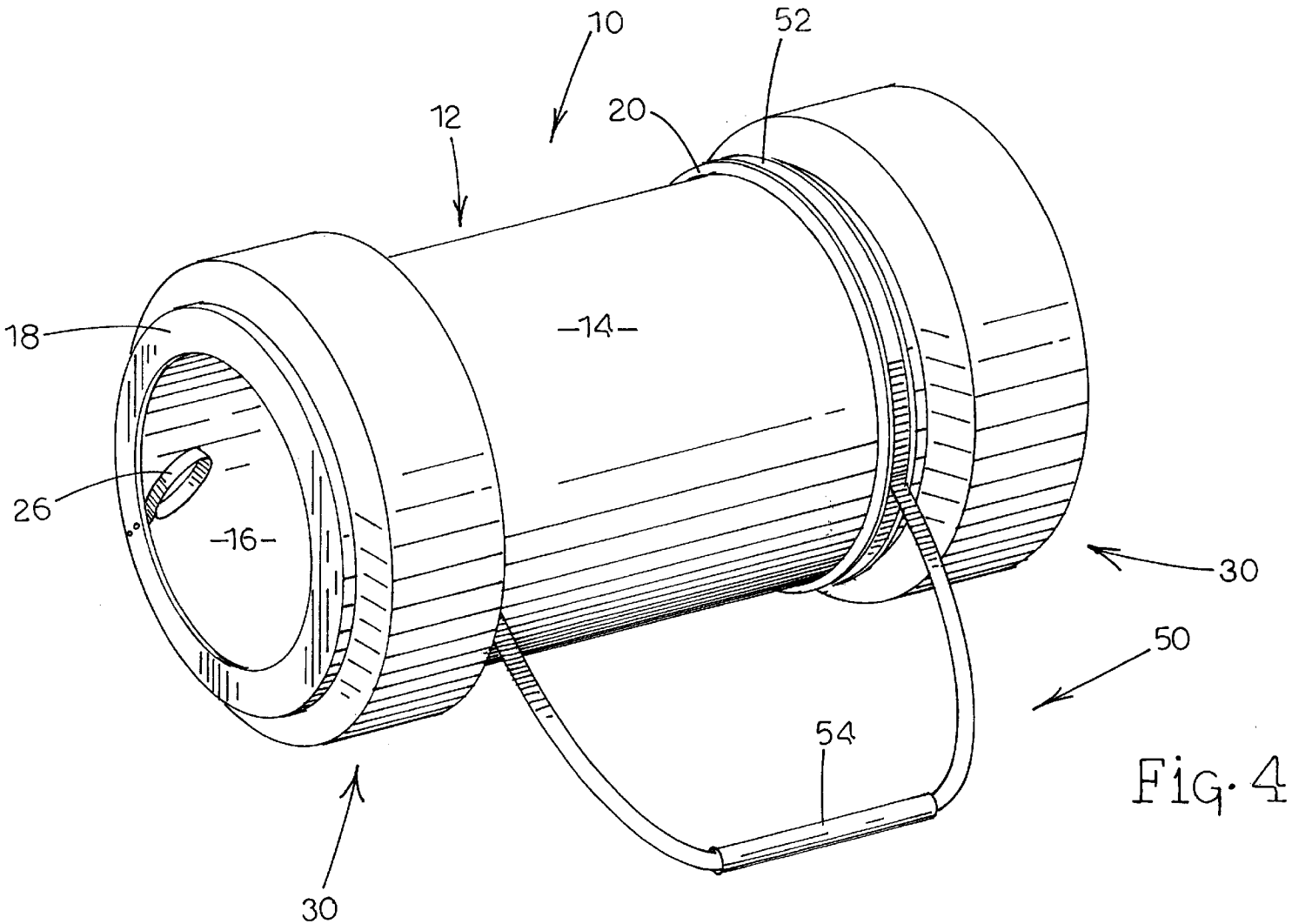
FIG. 4 is a perspective view of a second embodiment of the tumbling toy.
Figure 5:
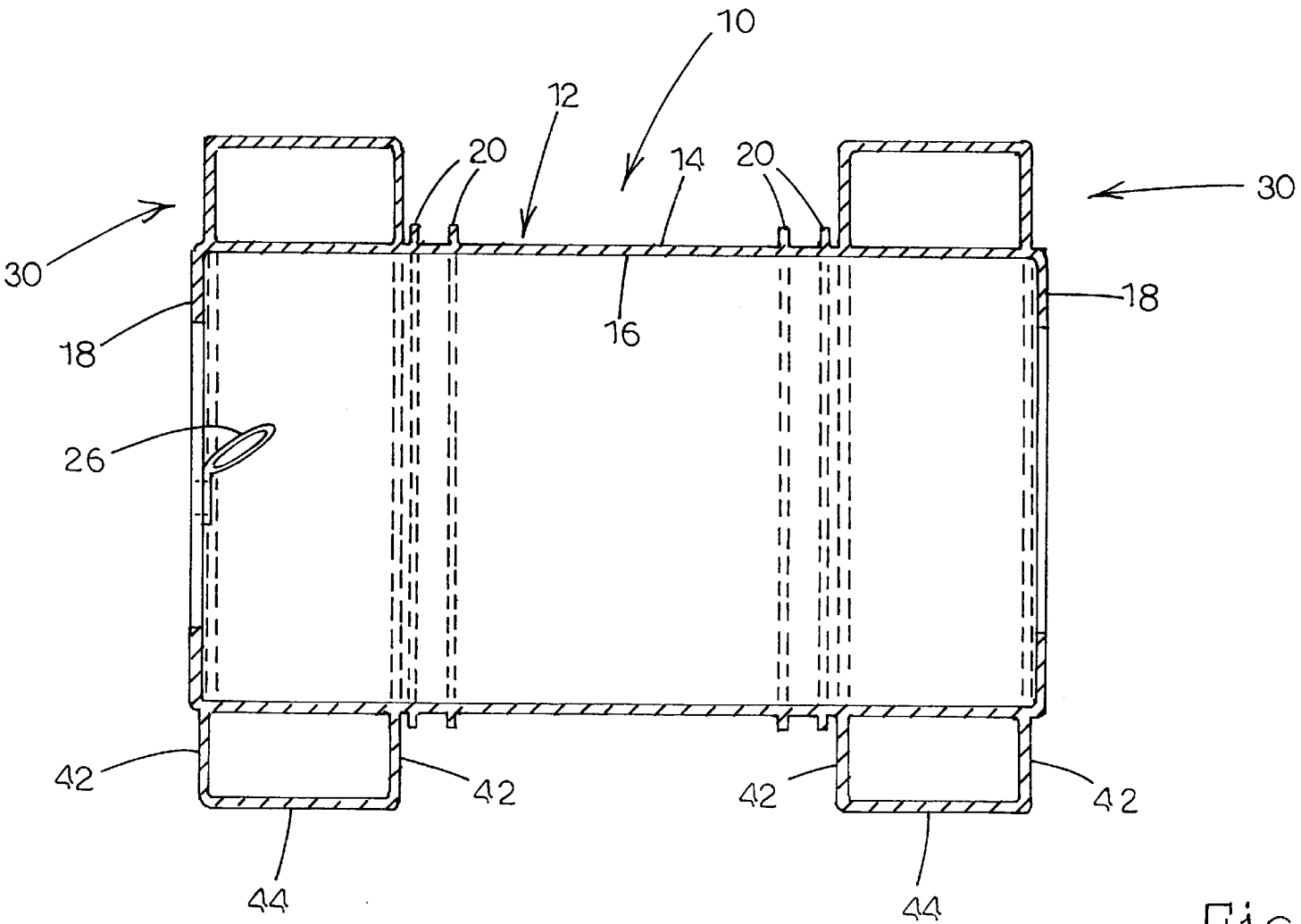
FIG. 5 is a transverse sectional view of the tumbling toy shown in FIG. 4.

A second embodiment of the tumbling toy 10 is shown in FIGS. 4 and 5. In this embodiment, the wheels 30 are integrally formed with the tube 12. More particularly, in the case of this embodiment, the wheels 30 are molded along with the tube 12 to form an integral molded plastic structure. As seen in FIG. 5, each wheel 30 extends outwardly from the tube 12 and includes a pair of opposed sides 42 and a periphery 44 extending between the sides.

It is contemplated that in one embodiment of the present invention, the tumbling toy 10 would be provided with a pull, indicated generally by the numeral 50. Pull 50 includes a flexible and pliable rope-like structure that includes a pair of loops 52. Each loop is adapted to extend around tube 12 adjacent the inside of a respective wheel 30. More particularly, each loop is confined within the guide structure formed by the guide rails 20. The loops 52 are extended around and between the guide rails 20 in such a fashion that the tube can rotate with respect to the loops 52. In any event, extending from the loops, is a transverse handle 54 that effectively connects the loops 52. Again, handle 54 and loops 52 are designed such that the tube 12, and consequently the wheels 30, can rotate with respect to the loops 52 as the tumbling toy is pulled over the ground or other support surface.

To reduce the size of the tumbling toy 10 for purposes of shipping, it will be appreciated by those skilled in the art that the tube 12 and even the tube 12 and associated wheels of the integral construction of FIGS. 4 and 5 can be made in sections. These sections can be designed to nest together for compact storage and shipment, and can further be adapted to easily connect together to form an assembled tumbling toy 10.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A tumbling toy, comprising:

a. a tumbling tube comprising an opening large enough to enable a person to fit within the tumbling tube;

b. a pair of spaced apart wheels for supporting the tumbling tube; and c. a pull connected to the tumbling toy for enabling the tumbling toy to be pulled, the pull being adapted to connect to the tumbling toy such that the tumbling tube and wheels may rotate relative to the pull.

2. The tumbling toy of claim 1 wherein the pull includes at least one loop that at least partially encircles the tumbling toy and wherein the tumbling toy rotates within the loop as the tumbling toy is pulled.

3. The tumbling toy of claim 1 wherein the pull includes a pair of spaced apart loops that encircle the tumbling tube, and a handle connected to the loops and extending therefrom.

4. The tumbling toy of claim 3 wherein the pull including the loops and handle, is constructed of a flexible material.

5. The tumbling toy of claim 4 wherein the pull includes a flexible rope.

6. The tumbling toy of claim 3 wherein the tumbling tube is provided with a pair of spaced apart guides, each guide adapted to maintain a respective loop of the pull about the tumbling tube.

7. The tumbling toy of claim 6 wherein each guide defines a circumferential area around the tumbling tube and confines a respective loop within the circumferential area.

8. The tumbling toy of claim 1 wherein the tumbling tube is constructed of a first material and the wheels are constructed of a second material.

9. The tumbling toy of claim 8 wherein the second material is an inflatable material that enables the wheels to be inflated.

10. The tumbling toy of claim 9 including a series of straps that extend around a portion of each wheel and effectively retain the wheel to the tumbling tube.

11. The tumbling toy of claim 10 wherein the straps extend from the tumbling tube and around a portion of the wheel so as to secure the wheels to opposed end portions of the tumbling tube.

12. The tumbling toy of claim 11 wherein each strap includes opposite end portions with one end portion being secured to the tumbling tube and the other end portion being detachably secured to the tumbling tube by hook and loop fasteners.

13. The tumbling toy of claim 1 wherein the tumbling tube extends through the wheels such that the wheels are supported on the tumbling tube.

14. The tumbling toy of claim 13 wherein the tumbling tube is constructed of a rigid plastic material and the wheels are constructed of an inflatable material.

15. The tumbling toy of claim 13 wherein both the tumbling tube and the wheels are constructed of a rigid plastic material.

16. The tumbling toy of claim 1 including one or more hand holds secured to the tumbling tube.

17. A tumbling toy, comprising:

a rigid tube having a central opening and a pair of opposed end portions large enough to fit a person;

a pair of wheels for supporting the tube;

each wheel extending around an end portion of the tube such that the tube projects through the wheels and supports the wheels; and wherein each wheel is inflatable and constructed in part at least of a pliable material such that when the tumbling toy is packaged the pliable inflatable material may be deflated so as to reduce the overall size of the tumbling toy for packaging.

18. The tumbling toy of claim 17 wherein the rigid tube is constructed of a plastic material.

19. The tumbling toy of claim 18 wherein the wheels are constructed of a rigid plastic material.

20. The tumbling toy of claim 17 wherein each wheel is inflatable and constructed in part at least of a pliable material such that the wheels may be inflated to support the rigid; and wherein there is provided a series of straps for securing each wheel about an end portion of the rigid tube.

21. The tumbling toy of claim 20 wherein the straps are circumferentially spaced with each strap extending transversely over a portion of each wheel when the wheel is inflated.

22. The tumbling toy of claim 20 wherein each strap includes two opposed ends with one end being adapted to be secured to the tumbling toy.

23. The tumbling toy of claim 17 including a pull connected to the tumbling toy for enabling the tumbling toy to be pulled, the pull being adapted to be connected to the tumbling toy such that the rigid tube and wheels may rotate relative to the pull.

24. The tumbling toy of claim 19 including a pull connected to the tumbling toy for enabling the tube and wheels to rotate relative to the pull.

25. The tumbling toy of claim 19 wherein the wheels are integrally constructed with the tube.

26. A tumbling toy comprising:

a rigid tube having a central opening and a pair of opposed end portions large enough to fit a person;

a pair of wheels for supporting the tube;

each wheel extending around an end portion of the tube such that the tube projects through the wheels and supports the wheels;

wherein the rigid tube is constructed of a plastic material; and wherein the wheels are constructed of a rigid plastic material.

* * * * *